US009991077B2

(12) United States Patent
Sohn

(10) Patent No.: US 9,991,077 B2
(45) Date of Patent: Jun. 5, 2018

(54) CURRENT LIMITING DEVICE OF CIRCUIT BREAKER

(71) Applicant: LSIS CO., LTD., Anyang-si, Gyeonggi-do (KR)

(72) Inventor: Jongmahn Sohn, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days. days.

(21) Appl. No.: 15/406,689

(22) Filed: Jan. 14, 2017

(65) Prior Publication Data

US 2017/0323751 A1 Nov. 9, 2017

(30) Foreign Application Priority Data

May 3, 2016 (KR) ..... 10-2016-0054823

(51) Int. Cl.
*H01H 3/40* (2006.01)
*H01H 71/02* (2006.01)

(52) U.S. Cl.
CPC ... *H01H 71/0235* (2013.01); *H01H 2205/002* (2013.01); *H01H 2235/004* (2013.01)

(58) Field of Classification Search
CPC ..... H01H 73/00; H01H 73/02; H01H 73/06; H01H 2009/02; H01H 2009/0278; H01H 2071/00; H01H 2071/02; H01H 2221/062; H01H 2223/00; H01H 2223/044; H01H 71/0235; H01H 2205/002; H01H 2235/004; H01H 1/50; H01H 1/64; H01H 9/0044; H01H 9/02; H01H 9/0207; H01H 9/0264; H01H 71/00; H01H 71/02; H01H 71/0214; H01H 71/022
USPC ..... 200/500
See application file for complete search history.

(56) References Cited

U.S. PATENT DOCUMENTS

| | | | |
|---|---|---|---|
| 5,310,971 | A | 5/1994 | Vial et al. |
| 2009/0057112 | A1 | 3/2009 | Bennett et al. |
| 2015/0060249 | A1 | 3/2015 | Biedunkiewicz et al. |

FOREIGN PATENT DOCUMENTS

| | | |
|---|---|---|
| EP | 0978858 | 2/2000 |
| JP | 1994052777 | 2/1994 |
| KR | 2019990016830 | 5/1999 |
| KR | 1019990039209 | 6/1999 |
| KR | 100290932 | 3/2001 |
| KR | 1020050101248 | 10/2005 |

OTHER PUBLICATIONS

European Patent Office Application Serial No. 16199068.4, Search Report dated Mar. 28, 2017, 7 pages.
Korean Intellectual Property Office Search Report dated Apr. 22, 2016, 4 pages.

*Primary Examiner* — Anthony R. Jimenez
(74) *Attorney, Agent, or Firm* — K&L Gates LLP

(57) ABSTRACT

In present disclosure, a movable bar guide portion is formed to protrude toward a movable bar in a shaft having a movable bar, and when a fault current is applied and the movable bar is rotated due to electromagnetic repulsion force, the movable bar and the movable bar guide portion contact each other, and thus, when the movable bar is rotated through the movable guide portion, movement of a rotation center of the movable bar is minimized.

2 Claims, 6 Drawing Sheets

CURRENT LIMITING DEVICE OF CIRCUIT BREAKER

CROSS-REFERENCE TO RELATED APPLICATION

Pursuant to 35 U.S.C. § 119(a), this application claims the benefit of earlier filing date and right of priority to Korean Application No. 10-2016-0054823, filed on May 3, 2016, the contents of which are all hereby incorporated by reference herein in its entirety.

BACKGROUND OF THE DISCLOSURE

1. Field of the Disclosure

The present disclosure relates to a current limiting device, and particularly, to a current limiting device of a circuit breaker capable of preventing a degradation of current limiting performance due to a difference in contact repulsion force between a movable contact and a fixed contact when a fault current is applied.

2. Background of the Disclosure

In general, a molded case circuit breaker (MCCB) is installed mainly in a distribution board of an electric power receiving and distribution facility of a factory, building, and the like. In a non-load state, the MCCB serves as an opening and closing device for supplying power to a load side or cutting off power supply, and when a load is in use, if an abnormal phenomenon occurs in a load line and a large current exceeding a load current flows, the MCCB serves as a circuit breaker supplies power supplied from a power source to a load or cuts off power in order to protect an electric wire of an electric line and a load side device.

When a circuit is abnormal, the MCCB has a function of quickly breaking an electric path to prevent damage to a line or a connection device or prevent outbreak of fire.

On the other hand, when a fault current occurs in the MCCB, a contact repulsion force is generated between a fixed contact and a movable contact provided in the MCCB, and due to the contact repulsive force, a movable bar having a movable contact moves at a fast speed to secure a predetermined distance from the fixed contact, and an arc generated between the fixed contact and the movable contact is extinguished by an arc extinguishing unit, so as to be broken.

Breaking of a current due to the aforementioned process is called current limiting characteristics. According to the current limiting characteristics, a contact is separated within a fast time using the contact repulsion force, and based on which a circuit breaker for a low voltage may have a high breaking capacity.

The MCCB has a dual contact in addition to a single contact to have a double rotating contact structure having a dual arc extinguishing structure.

Unlike a single contact structure, the double rotating contact structure is a structure that a contact repulsion force is generated in mutually opposite directions based on a certain axis to rotate the movable bar, and since double contact repulsion force works, compared with the single contact structure, the movable contact is separated from the fixed contact at a fast speed, obtaining excellent current limiting characteristics.

On the other hand, FIG. 1 is a schematic configuration diagram illustrating a current limiting device having a double rotating contact structure provided in the related art molded case circuit breaker (MCCB), FIG. 2 is a schematic configuration diagram illustrating a state immediately before a current limiting device having a double rotating contact structure provided in the related art MCCB toggles a limited current, and FIG. 3 is a schematic configuration diagram illustrating a state that a current limiting device having a double rotating contact structure provided in the related art MCCB completes toggling of a limited current.

Also, FIG. 4 is a schematic configuration diagram illustrating positions of a movable bar rotational axis and a shaft rotational axis in a state immediately before a current limiting device having a double rotating contact structure provided in the related art MCCB toggles a limited current, FIG. 5 is a schematic configuration diagram illustrating positions of a movable bar rotational axis and a shaft rotational axis in a state after a current limiting device having a double rotating contact structure provided in the related art MCCB completes toggling of a limited current, and FIG. 6 is a schematic configuration diagram illustrating a state in which a movable bar is connected to a shaft in a current limiting device having a double rotating contact structure provided in the related art MCCB.

As illustrated in FIGS. 1 to 6, a current limiting device provided in a related art MCCB 10 includes a fixed bar 11 connected to a load side and a power source side and having a fixed contact 11*a*, a shaft 13 having an elastic member 17 on an inner side, and a movable bar 15 positioned on an inner side of the shaft 13 and having a movable contact 15*b* moved according to whether a fault current occurs and separated from the fixed contact 11*a*.

Also, a movable bar pin 15*a* is provided in the movable bar 15, a shaft pin 13*a* is provided in the shaft 13, and one ends and the other ends of four elastic member 17 are connected to the movable bar pin 15*a* and the shaft pin 13*a*. When the movable bar 15 is rotated centered on a certain movable bar rotational axis R to pass a predetermined point according to occurrence of a fault current, the movable bar 15 is positioned in a position spaced apart from the fixed bar 11 upon receiving elastic force from the elastic member 17.

That is, when a fault current is applied to the MCCB 10, a contact repulsion force is generated between the fixed contact 11*a* and the movable contact 15*b*, and thus, the movable bar 15 rotates within the shaft 13. At this time, when the movable bar 15 passes a predetermined point, the movable bar 15 is positioned spaced apart from the fixed bar 11.

However, in the case of a current limiting device of the related art MCCB 10 having the double rotating structure as described above, since a surface state of a contact is changed by an arc after an open short circuit test, a symmetrical repulsion force does not occur all the time. Due to the asymmetrical electromagnetic repulsion force, as a certain movable bar rotational axis R becomes distant from a central axis C of the shaft 13, one movable bar 15 reaches the shaft pin 13*a* more rapidly and first moves to a predetermined point along one side of the movable bar 15. Thus, a stronger force should be acted on the other movable bar 15 than a symmetrical state in spite of a weak electromagnetic repulsion force, in order to move to a predetermined point along one side of the movable bar 15.

At this time, when an electronic repulsion pulse is not sufficient, the movable bar 15 is not fixed to the surface of one movable bar 15 and the movable bar 15 is rotated in the opposite direction of an electromagnetic repulsion force by an elastic member 17, so a distance between the fixed contact and the movable contact is not maintained to cause an error in a breaking operation.

This problem arises in breaking a small current having a small electromagnetic repulsion force frequently more than in breaking a large current.

Also, when one contact repulsion force between the fixed contact 11*a* and the movable contact 15*b* positioned on both sides is asymmetrically larger than the other side, rotating speeds of both sides of the movable bar 15 are different due to a difference in contact repulsion force, and thus, a certain rotation center moves toward a side where the contact repulsion force is smaller.

Also, in breaking a large current, a sufficient contact repulsion force is generated. Thus, even though a rotation center of the movable bar 15 moves toward a smaller contact repulsion force, there is a high possibility that, after one movable bar 15 is fixed to the shaft pin 13*a*, the other movable bar 15 passes a dead point and is fixed to the shaft pin 13. However, in breaking a small current, contact repulsion force is so small that when a rotation center is moved by an asymmetrical repulsion force, a side having a smaller contact repulsion force in the movable bar 15 may not be able to pass a dead point and fixed to the shaft pin 13*a*.

Also, since the side having a smaller contact repulsion force in the movable bar 15 is not able to pass a dead point, each contact cannot be completely separated to maintain an opening distance, and rotated in the opposite direction by the contact repulsion force through the elastic member 17 and moved to a contact position, significantly reducing breaking performance of the MCCB 10.

SUMMARY OF THE DISCLOSURE

Therefore, an aspect of the detailed description is to provide a current limiting device of an MCCB capable of preventing a degradation of current limiting performance due to a difference in a contact repulsion force between a movable contact and a fixed contact when a short-circuit current is applied.

To achieve these and other advantages and in accordance with the purpose of this specification, as embodied and broadly described herein, a current limiting device of a circuit breaker including a shaft, a movable bar positioned on an inner side of the shaft and contacting the fixed bar or separated from the fixed bar, and the fixed bar supplying power according to contact or separation of the movable bar, wherein at least one movable bar guide portion is formed to protrude in a direction of a central axis of the movable bar in the shaft, and a cam part is formed on an upper surface or a lower surface of the movable bar, and contacts the movable bar guide portion to adjust movement of the movable bar when the movable bar is rotated as a fault current is applied.

Also, a plurality of shaft pins to which an elastic member is connected may be formed in the shaft, and an insertion recess may be formed at the movable bar, positioned to be adjacent to the cam part, and allow the shaft pin to be inserted when the movable bar is moved.

The cam part may include a first cam surface formed to be sloped upwards at a predetermined length to guide the shaft pin to be inserted into the insertion recess, and a second cam surface formed to be sloped downwards from the first cam surface and moved along the movable bar guide.

In the current limiting device of the circuit breaker of the present disclosure as described above, since the movable bar guide portion is formed to protrude toward the movable bar in the shaft having the movable bar and the movable bar and the movable bar guide portion contact each other, when the movable bar is rotated through the movable guide portion, movement of the rotation center of the movable bar is minimized.

Also, since movement of the rotation center of the movable bar is minimized, when a fault current occurs, only the side of the movable bar in which the contact repulsion force is large is moved to pass a dead point and the side of the movable bar in which the contact repulsion force is small does not pass the dead point, whereby the movable bar is prevented from being moved again to the contact position.

In addition, since the rotated movable bar is prevented from being moved again to the contact position, a degradation of breaking performance of the circuit breaker 100 is prevented.

In addition, since movement of the rotation center of the movable bar 120 is minimized, a time for the movable bar to be moved to a predetermined opening position from the fixed bar is shortened.

In addition, since the time for moving to the predetermined opening position is shortened, an arc can be quickly broken.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a current limiting device of a circuit breaker according to an embodiment of the present disclosure will be described with reference to the accompanying drawings.

Figure 1:
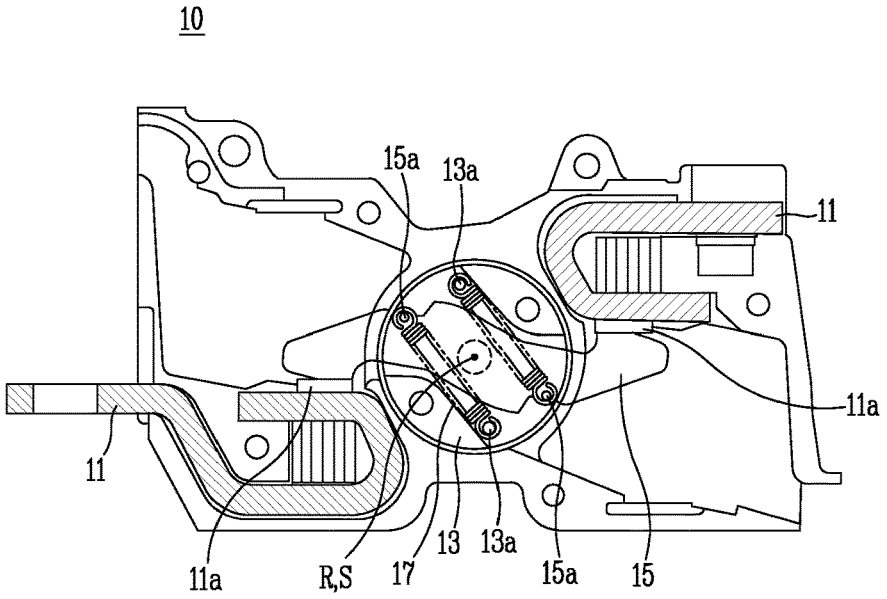
FIG. 1 RELATED ART
FIG. 1 is a schematic configuration diagram illustrating a current limiting device having a double rotating contact structure provided in the related art molded case circuit breaker (MCCB).
Figure 2:
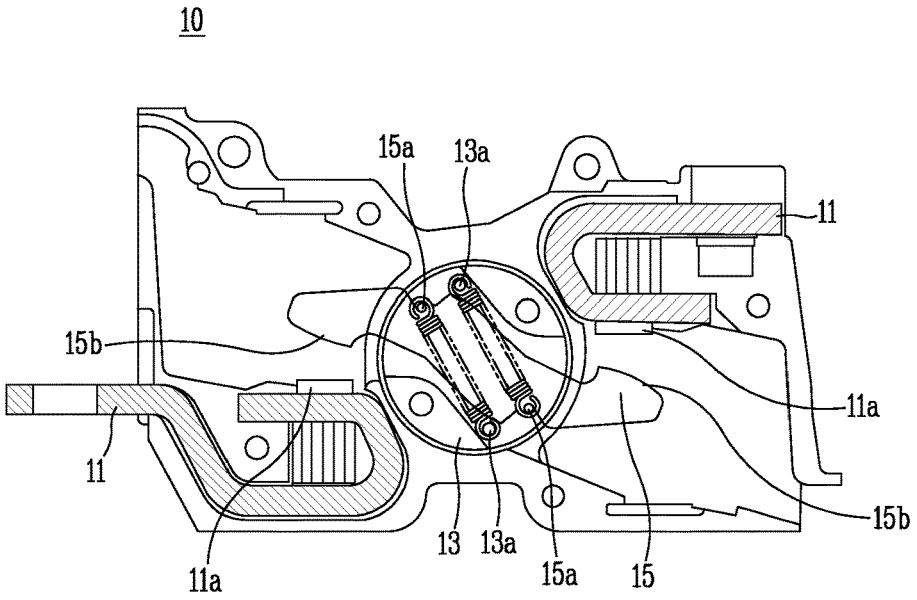
FIG. 2 RELATED ART
FIG. 2 is a schematic configuration diagram illustrating a state immediately before a current limiting device having a double rotating contact structure provided in the related art MCCB toggles a limited current.
Figure 3:
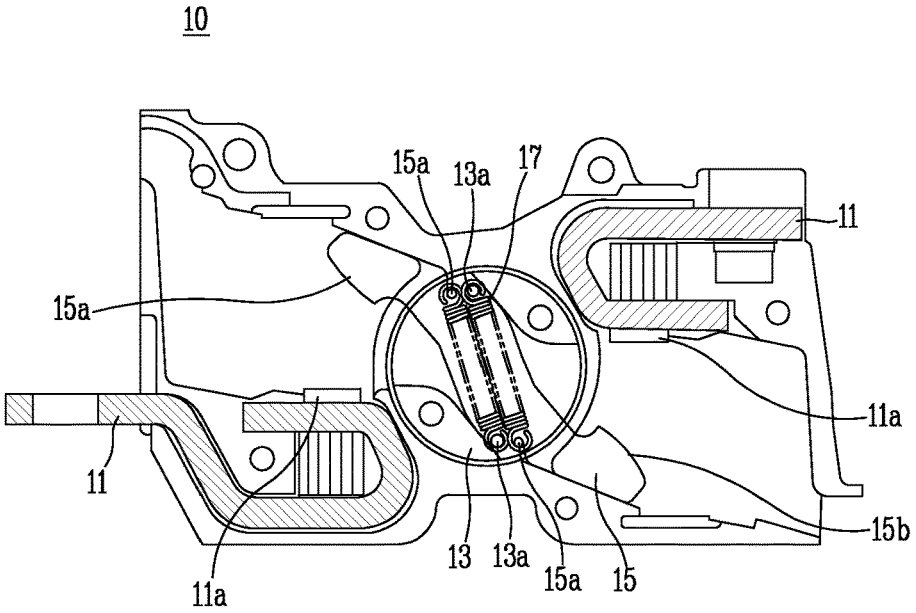
FIG. 3 RELATED ART
FIG. 3 is a schematic configuration diagram illustrating a state that a current limiting device having a double rotating contact structure provided in the related art MCCB completes toggling of a limited current.
Figure 4:
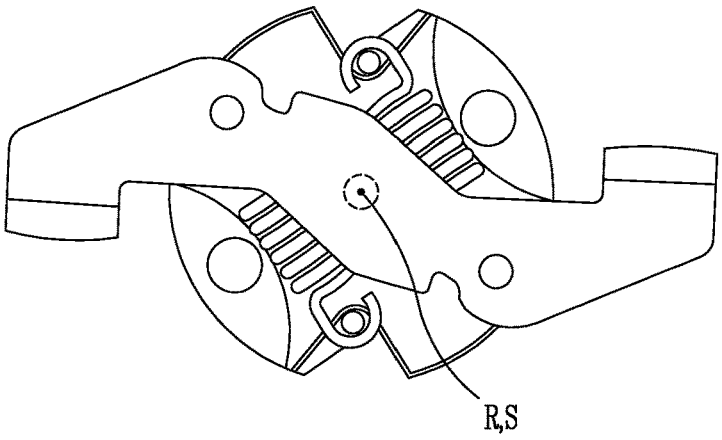
FIG. 4 RELATED ART
FIG. 4 is a schematic configuration diagram illustrating positions of a movable bar rotational axis and a shaft rotational axis in a state immediately before a current limiting device having a double rotating contact structure provided in the related art MCCB toggles a limited current.
Figure 5:
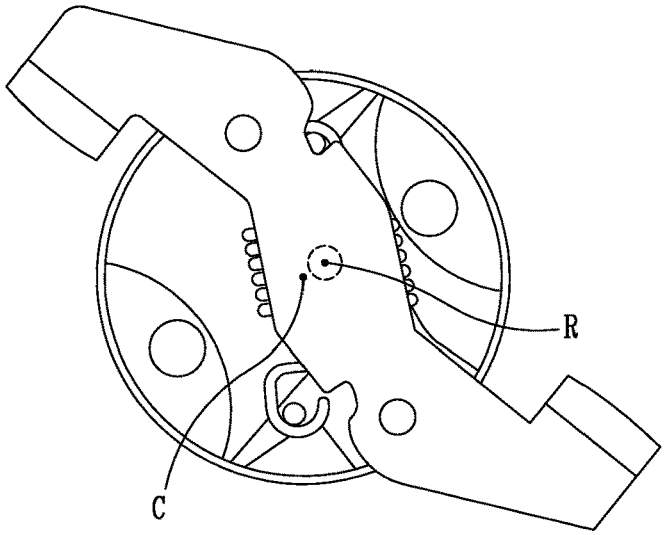
FIG. 5 RELATED ART
FIG. 5 is a schematic configuration diagram illustrating positions of a movable bar rotational axis and a shaft rotational axis in a state after a current limiting device having a double rotating contact structure provided in the related art MCCB completes toggling of a limited current.
Figure 6:
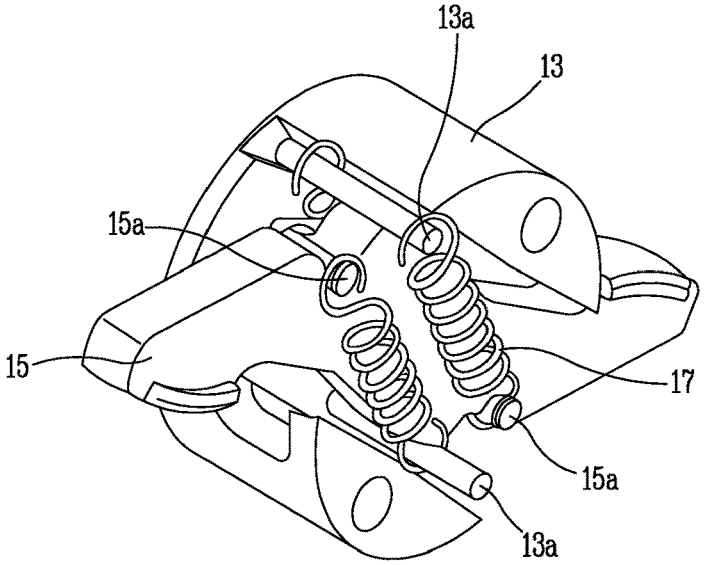
FIG. 6 RELATED ART
FIG. 6 is a schematic configuration diagram illustrating a state in which a movable bar is connected to a shaft in a current limiting device having a double rotating contact structure provided in the related art MCCB.
Figure 7:
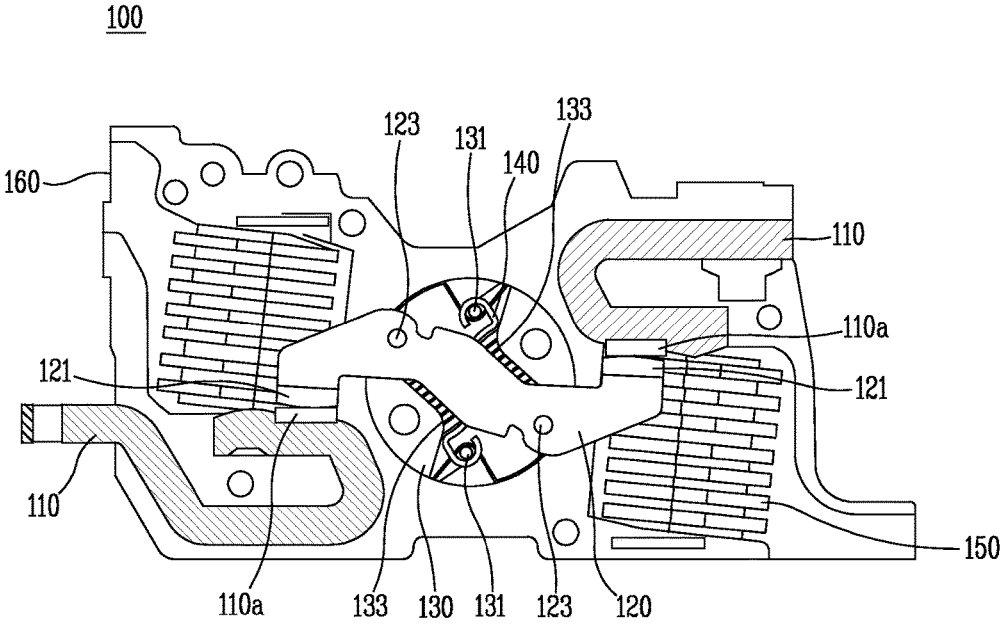
FIG. 7 is a schematic configuration diagram illustrating a current limiting device having a double rotating contact structure provided in an MCCB according to the present disclosure.
Figure 8:
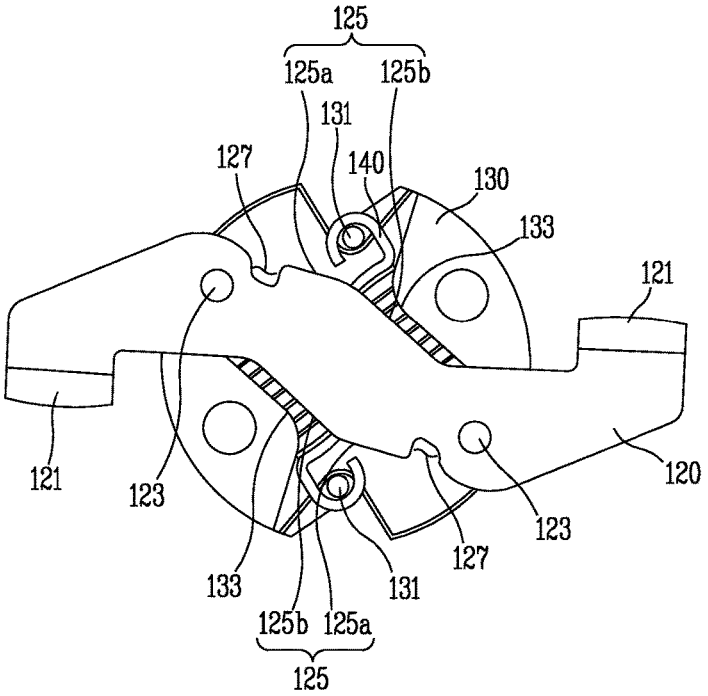
FIG. 8 is a schematic configuration diagram illustrating a state that a movable bar is connected to a shaft in an MCCB according to the present disclosure.
Figure 9:
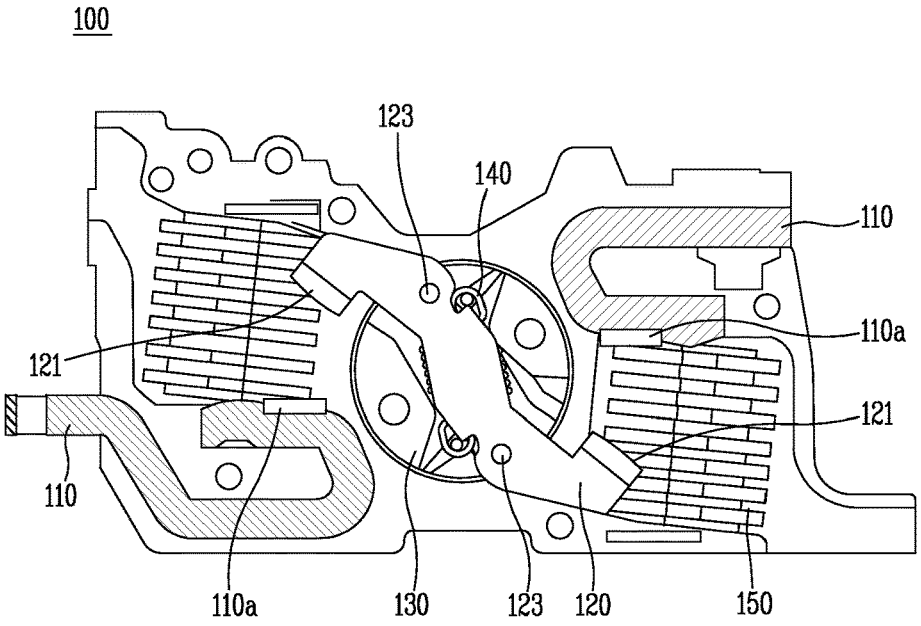
FIG. 9 is a schematic configuration diagram illustrating a state that a current limiting device having a double rotating contact structure provided in an MCCB according to the present disclosure is toggling a limited current.

FIG. 7 is a schematic configuration diagram illustrating a current limiting device having a double rotating contact structure provided in an MCCB according to the present disclosure, FIG. 8 is a schematic configuration diagram illustrating a state that a movable bar is connected to a shaft in an MCCB according to the present disclosure, and FIG. 9 is a schematic configuration diagram illustrating a state that a current limiting device having a double rotating contact structure provided in an MCCB according to the present disclosure is toggling a limited current.

Figure 10:
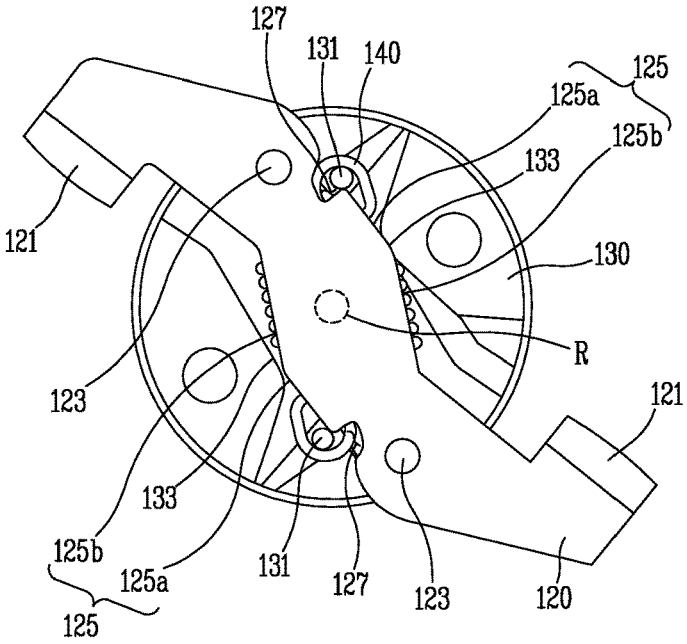
FIG. 10 is a schematic configuration diagram illustrating a state that a movable bar is connected to a shaft in a state that an MCCB according to the present disclosure toggles a limited current.
Figure 11:
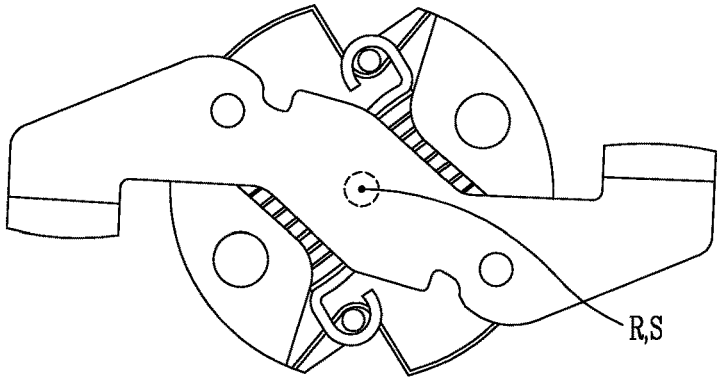
FIG. 11 is a schematic configuration diagram illustrating a movable bar rotational axis and a shaft central axis in a state that a current limiting device having a double rotating contact structure provided in an MCCB according to the present disclosure is toggling a limited current.
Figure 12:
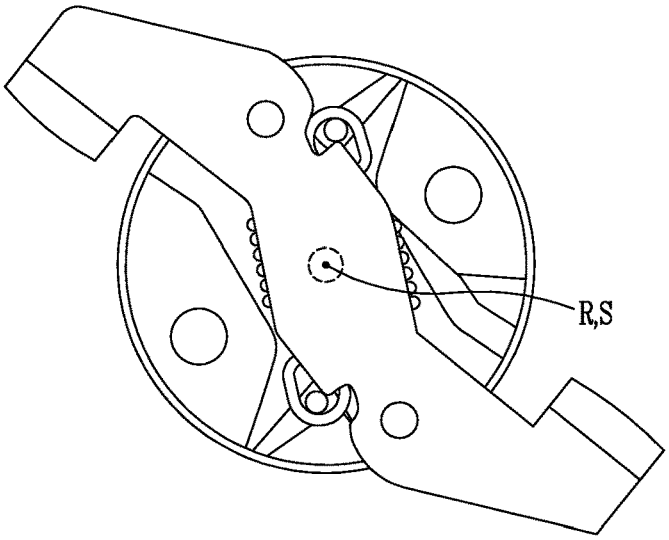
FIG. 12 is a schematic configuration diagram illustrating a movable bar rotational axis and a shaft central axis in a state that a current limiting device having a double rotating contact structure provided in an MCCB according to the present disclosure toggles a limited current.

Also, FIG. 10 is a schematic configuration diagram illustrating a state that a movable bar is connected to a shaft in a state that an MCCB according to the present disclosure toggles a limited current, FIG. 11 is a schematic configuration diagram illustrating a movable bar rotational axis and a shaft central axis in a state that a current limiting device having a double rotating contact structure provided in an MCCB according to the present disclosure is toggling a limited current, and FIG. 12 is a schematic configuration diagram illustrating a movable bar rotational axis and a shaft central axis in a state that a current limiting device having a double rotating contact structure provided in an MCCB according to the present disclosure toggles a limited current.

As illustrated in FIGS. 7 and 8, a current limiting device of a circuit breaker 100 according to the present disclosure includes components within a case 160 of the circuit breaker 100, and here, the current limiting device of a circuit breaker includes a plurality of fixed bars 110 provided in the case 160 and connected to a load side and a power source side to supply power to a load side, a shaft 130 having a plurality of elastic members 140 and having a movable bar 120 positioned therein and rotated, and the movable bar 120 provided within the shaft 130 and rotated at a predetermined distance according to whether a fault current is applied.

Here, a plurality of shaft pins 131 are formed at the shaft 130 such that one end of the elastic member 140 such as a plurality of springs is connected, and a plurality of movable bar fins 123 is formed at the movable bar 120 such that the other end of the elastic member 140 is connected.

Thus, the elastic member 140 is connected to the shaft pin 131 and the movable bar pin 123 to provide elastic force to the movable bar 120, and a movable contact 121 formed at the movable bar 120 contacts a fixed contact 110*a* formed at the fixed bar 110 or separated from the fixed contact 110*a* through elastic force of the elastic member 140.

On the other hand, at least one movable bar guide portion 133 is formed at the shaft 130 and protrudes in a direction of the movable bar 120. As illustrated in FIGS. 9 and 10, when a fault current is applied to the circuit breaker 100 to generate a different asymmetrical contact repulsion force is generated between each movable contact 121 and each fixed contact 110*a*, the side of the movable bar 120 in which a large contact repulsion force is generated is rapidly rotated, and here, the movable bar guide portion 133 contacts the movable bar 120 to prevent a rotation center R of the movable bar 120 from moving to a side in which a contact repulsion force is small.

That is, when a fault current is applied to generate a contact repulsion force between the fixed contact 110*a* and the movable contact 121 so the movable bar 120 is rotated by the contact repulsion force, in the double locating structure, a contact repulsion force may be differently generated between contacts. When the contact repulsion force is generated differently, one end of a side of the movable bar 120 in which the contact repulsion force is large is rapidly moved, and thus, the rotation center R is moved to a side of the movable bar 120 in which the contact repulsion force is small.

Thus, in the related art, in a state that the contact repulsion force is differently generated, when the movable bar 120 is rotated in a clockwise direction, a side of the movable bar 120 in which the contact repulsion force is large is rapidly rotated and positioned in a state of passing a dead point, and the other side in which the contact repulsion force is small is positioned in a state of not passing the dead point, and thus, the respective contacts are moved again to the contact position by the elastic member 140, remarkably degrading breaking performance. However, in the case of the present disclosure, when the movable bar 120 is moved, since it contacts the movable guide portion 133, the rotation center R of the movable bar 120 is prevented from moving, and thus, both sides of the movable bar 120 pass the dead point together to complete a limited current toggling state (state that the movable bar 120 is rotated by the contact repulsion force and fixed to a predetermined opening position), whereby the movable bar 120 is maintained in a predetermined opening position from the fixed bar 110.

On the other hand, a cam part 125 contacting the movable guide portion 133 to adjust a movement of the movable bar 120 when the movable bar 120 is moved is formed on an upper surface or a lower surface of the movable bar 120.

Also, an insertion recess 127 is formed at the movable bar 120 and positioned to be adjacent to the cam part 125 such that the shaft pin 131 is inserted when the movable bar 120 is moved.

Here, the cam part 125 includes a first cam surface 125*a* and a second cam surface 125*b*. The first cam surface 125*a* is formed to be sloped upwards at a predetermined length, so that when the movable bar 120 is rotated, the first cam surface 125 contacts the shaft pin 131 to guide the shaft pin 131 to be inserted into the insertion recess 127.

Also, the second cam surface 125*b* is formed to be sloped downwards from the first cam surface 125*a*, so that when the movable bar 120 is rotated, the second cam surface 125*b* contacts the movable bar guide portion 133 such that the movable bar 120 moves along the movable bar guide portion 133.

Hereinafter, an operation process of the current limiting device of the circuit breaker 100 according to the present disclosure will be described in detail.

First, as illustrated in FIG. 11, when the movable contact 121 of the movable bar 120 and the fixed contact 110*a* of the fixed bar 110 contact each other, a certain movable bar rotational axis R and the shaft center shaft C are aligned.

Here, when a fault current is applied to the circuit breaker 100, the movable bar 120 is rotated in a clockwise direction due to a contact repulsion force generated between the movable contact 121 and the fixed contact 110*a* so as to be positioned in a limited current toggling state as illustrated in FIGS. 9 and 10.

Also, when a contact repulsion force at both sides of the movable bar 120 is differently asymmetrically generated, one side of the movable bar 120 in which the contact repulsion forced is large is rapidly rotated to be moved.

When the movable bar 120 is moved by a predetermined distance or greater, the second cam surface 125*b* forming a cam part 125 contacts the movable bar guide portion 133 formed within the shaft 130, so that, as illustrated in FIG. 12, a certain movable bar rotational axis (rotation center R) is prevented from being moved to be aligned with the shaft central axis C and the second cam surface 125*b* is moved along the movable bar guide portion 133.

Thereafter, as the shaft pin 131 formed in the shaft 130 enters along the first cam surface 125*a* so as to be positioned in the insertion recess 127, the movable bar 120 is positioned in a state of passing a dead point, and thus, the movable bar 120 on the side in which the contact repulsion force is large is positioned to be spaced apart from the fixed bar 110.

Also, as for the movable bar 120 on the side in which the contact repulsion force is small, after the second cam surface 125*b* contacts the movable bar guide portion 133 so as to be moved, when the first cam surface 125*a* contacts the shaft pin 131, the shaft pin 131 is positioned in the insertion recess 127 and the movable bar 120 passes the dead point, whereby the movable bar 120 is completely separated from the fixed bar 110 and positioned to be spaced apart from the fixed bar 110 on both sides in which the contacts are positioned. Here, an arc generated between the fixed contact 110*a* and the movable contact 121 is extinguished through an arc extinguishing unit 150 so as to be broken.

In the current limiting device of the circuit breaker 100 of the present disclosure configured and operated as described above, the movable bar guide portion 133 is formed to protrude toward the movable bar 120 in the shaft 130 having the movable bar 120, and when the movable bar 120 is rotated, the movable bar 120 and the movable bar guide portion 133 contact each other, and thus, movement of the rotation center R of the movable bar 120 is minimized.

Also, since movement of the rotation center R of the movable bar 120 is minimized, when a fault current occurs, only the side of the movable bar 120 in which the contact repulsion force is large is moved to pass a dead point and the side of the movable bar 120 in which the contact repulsion force is small does not pass the dead point, whereby the movable bar 120 is prevented from being moved again to the contact position opposite to the contact repulsion force.

In addition, since the rotated movable bar 120 is prevented from being moved again to the contact position, a degradation of breaking performance of the circuit breaker 100 is prevented.

In addition, since movement of the rotation center R of the movable bar 120 is minimized, a time for the movable bar 120 to be moved to a predetermined opening position from the fixed bar 110 is shortened.

In addition, since the time for moving to the predetermined opening position is shortened, an arc can be quickly broken.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A current limiting device of a circuit breaker including a shaft, a movable bar positioned on an inner side of the shaft and contacting a fixed bar or separated from the fixed bar, and the fixed bar supplying power according to contact or separation of the movable bar, wherein at least one movable bar guide portion is formed to protrude in a direction of a central axis of the movable bar in the shaft, and a cam part is formed on one side of the movable bar which faces the movable bar guide portion and contacts the movable bar guide portion to limit the movement of a rotation center of the movable bar when the movable bar is rotated as a fault current is applied, wherein an insertion recess is formed at the moveable bar, positioned to be adjacent to the cam part, wherein a first cam surface is formed at the cam part, and being formed to be inclined toward the insertion recess, wherein the movable bar guide portion is positioned to abut on the first cam surface when the movable bar is rotated, and wherein when the movable bar is rotated as a fault current is applied, the first cam surface abuts on the movable bar guide portion, and moves along the movable bar guide portion to limit the movement of the rotation center of the movable bar.

2. The current limiting device of claim 1, wherein a plurality of shaft pins to which an elastic member is connected are formed in the shaft, and being inserted into an insertion recess when the movable bar is rotated.

* * * * *